US005734732A

United States Patent [19]

Lemmon

[11] Patent Number: 5,734,732

[45] Date of Patent: Mar. 31, 1998

[54] SPEAKER ARRANGEMENT AND MOUNTING APPARATUS AND METHOD

[76] Inventor: Harold J. Lemmon, 9884 Monroe Dr., Dallas, Tex. 75220

[21] Appl. No.: 741,040

[22] Filed: Oct. 30, 1996

[51] Int. Cl.[6] ..... H04R 1/02

[52] U.S. Cl. ..... 381/188; 181/154; 181/153; 381/24

[58] Field of Search ..... 381/24, 88, 90, 381/188, 205; 181/150, 153, 154

[56] References Cited

U.S. PATENT DOCUMENTS 4,194,086 3/1980 Solla .
4,441,577 4/1984 Kurihara ..... 381/86
4,475,226 10/1984 Greenberg ..... 381/24
4,673,057 6/1987 Glassco ..... 181/144
4,696,037 9/1987 Fierens ..... 381/24

*Primary Examiner*—Forester W. Isen
*Attorney, Agent, or Firm*—Harry C. Post, III

[57] ABSTRACT

Apparatus for mounting a speaker to a ceiling of a room that comprises an attaching ring adapted to be attached to a joist. A mounting ring is connected to the attaching ring. Apparatus to position the speaker at an angle relative to a front surface of the mounting ring and rotatably supports the speaker on the mounting ring so that a sound directional axis of the speaker may be rotated toward a chosen position in the room.

21 Claims, 5 Drawing Sheets

SPEAKER ARRANGEMENT AND MOUNTING APPARATUS AND METHOD

BACKGROUND OF THE INVENTION

This invention relates to a speaker arrangement for providing sound to a chosen position in a room, a method of providing sound to a chosen position in a room and speaker mounting apparatus, and, more particularly, to a speaker arrangement to provide surround sound to a chosen position in a room, a method of providing surround sound to a chosen position in a room and an adjustable speaker mounting apparatus.

It is well known that a set of first and second speakers are used in stereo systems to project sound into a room. For a listener to appreciate the sound projected from the stereo system, it is necessary for the listener to be properly positioned between the two speakers so that the speakers are directed toward the listener.

When the speakers can stand lone, they rest on the floor of the room and on opposite sides of a seat in which the listener is located while enjoying the music. The optimum sound quality is obtained by the listener through adjustment of the stereo system and either moving the speakers relative to the seat or moving the seat relative to the speakers. Sometimes, this adjustment is not possible, such as occurs when the speakers may not be moved or when the seat may not be moved.

When speakers are not as attractive as desirable or take up too much space in a room, the speakers might be mounted in the wall. Should speakers be mounted in the wall using conventional mounting apparatus, the sound dispersion axis of each speaker would be directed in a perpendicular direction to the plane formed by the vertical wall. Thus, only one location may be chosen in the room to receive sound with an optimum quality. If at a later date the listener decides to change this location, then either the speakers must be remounted, which is extremely time consuming and expensive, or the quality of the sound supplied at the new chosen location is adversely effected.

When stereo sound is projected into the room, the speakers would be mounted on facing walls. To insure optimum sound quality for this speaker configuration, the positioning of hanging decorations, such as pictures and paintings, of furniture and of shelving would be restricted in the room.

When surround sound is being projected into a room at least four speakers are employed, a first set of two speakers being positioned in the front and a second set of two speakers being positioned in the back. Since twice the number of speakers are being use, the problems previously discussed are even more severe.

It has, also, been found that the dimensions of the speakers commonly used to obtain superior sound quality, such as those used in providing surround sound, are larger than the dimensions available in a wall in which the speakers are to be placed.

Accordingly, it is an object of the present invention to provide a speaker arrangement to supply sound to a chosen position located in a room.

Further, it is an object of the present invention to provide a method of providing sound to a position in a room.

Further, it is an object of the present invention to provide apparatus for mounting a speaker to a joist of a room.

BRIEF SUMMARY OF THE INVENTION

In accordance with the present invention, there is provided a speaker arrangement for providing sound to a chosen position located in a room. The arrangement has at least two speakers capable of providing sound to the room and each speaker has a sound dispersion axis. A mounting assembly connects the speakers to a ceiling of the room at opposite sides of the chosen position. A positioning apparatus is included in the mounting assembly to support the speakers in a position that directs the sound dispersion axis toward the chosen position in the room.

Further, in accordance with the present invention, there is provided a method of providing sound to a position in a room. The method comprises the steps of choosing the position within the room to receive sound from at least two speakers. The speakers are located away from one another by a distance sufficient to include the chosen position. The located speakers are then mounted in a ceiling of the room. The mounted speakers are rotated to direct the sound toward the chosen position.

Further, in accordance with the present invention, there is provided apparatus for mounting a speaker to a joist of a room. The mounting apparatus comprises an attaching ring adapted to be attached to a joist. A mounting ring is connected to the attaching ring. Adjustable positioning apparatus is used to support the speaker at an angle relative to a front surface of the mounting ring and to rotatably support the speaker so that the sound dispersion axis of the speaker may be rotated toward a chosen position in the room.

BRIEF DESCRIPTION OF THE SEVERAL VIEWS OF THE DRAWING

Other objects and advantages of the invention will become apparent upon reading the following detailed description and upon reference to the drawings, wherein like reference characters are used throughout to designate like parts.

DETAILED DESCRIPTION OF THE INVENTION

Figure 1:
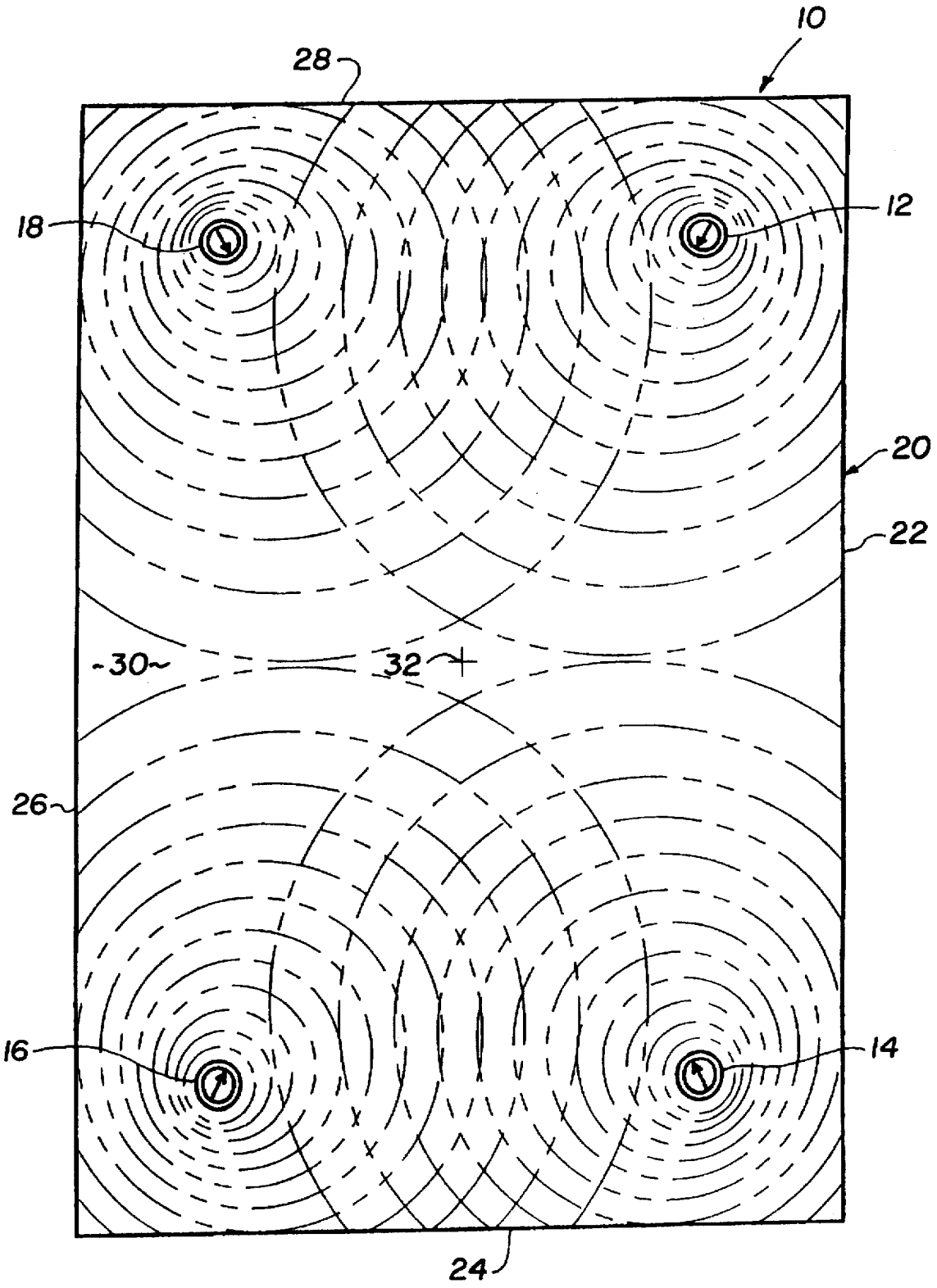
FIG. 1 is a schematic view of a speaker arrangement constructed according to the present arrangement.

Turning now to the drawing, there is shown in FIG. 1 an arrangement 10 of four speakers 12, 14, 16 and 18 projecting sound into a typical rectangularly shaped room 20 that has four walls 22, 24, 26 and 28, as viewed toward a ceiling 30 of the room. Speakers 12, 14, 16 and 18 are of conventional design and manufacture and project sound, as represented by the dotted lines around each speaker, from a conventional stereo or surround sound system into room 20 in the direction of the arrow on each speaker toward chosen position 32, as represented by the "X".

When a stereo system is being used to project sound into room 20, the speakers may be paired in any conventional manner to provide a set of speakers, such as a first set being paired speakers 12 and 16 and a second set being paired speakers 14 and 18. When desired, either set of paired speakers may be used independently of the other or they may be used in combination with each other.

When a surround sound system is being used to project sound into room 20, the first or front set of paired speakers may be speakers 12 and 18 while the second or back set of speakers may be speakers 14 and 16. When chosen position 32 is moved closer or further away from wall 24, speakers 12, 14, 16 and 18 are adjusted to aim toward the relocated chosen position and the surround sound system is adjusted accordingly.

To accomplish these results, each speaker 12, 14, 16 and 18 is mounted independently of the others to a joist 34, which may be the same or different, in ceiling 30 of room 20 by use of mounting apparatus 36 shown in FIGS. 2–7.

Figure 2:
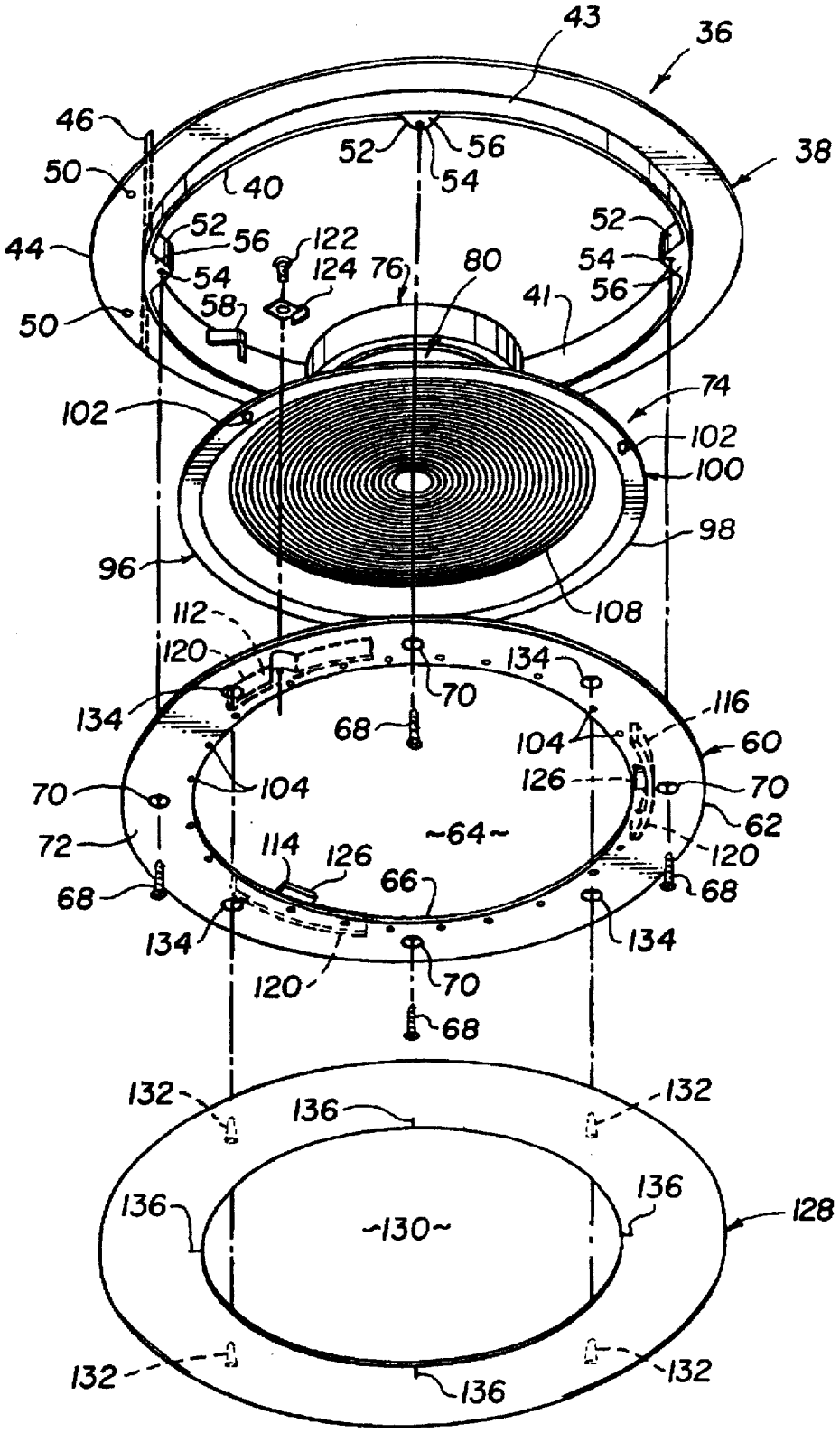
FIG. 2 is a perspective, exploded view of a speaker mounting assembly constructed according to the present invention.
Figure 3:
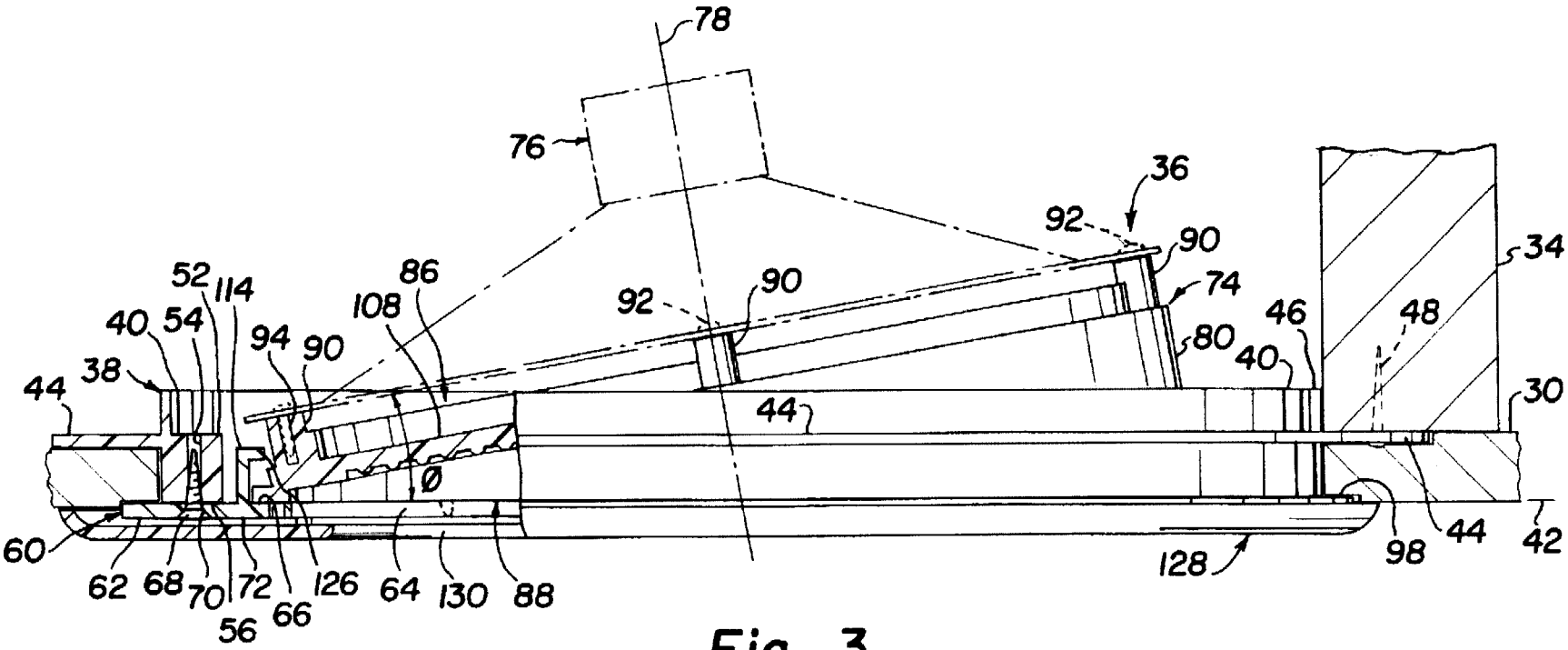
FIG. 3 is an elevational view of the assembled speaker mounting assembly shown in FIG. 2 connected to a joist of a room into which the music is directed.

Mounting apparatus 36 is connected to joist 34 by an attaching ring 38, which is best seen in FIGS. 2 and 3. Attaching ring 38 includes a ring member 40 with a generally tubular shape disposed to generally extend perpendicular to a plane 42 formed by ceiling 30 with walls defining the tubular passageway with an interior 41 and an exterior 43. Interior 41 forms a passageway through with the sound from the speakers pass into room 20. The two outer edges of the tubular shape of ring member 40 are disposed to lie substantially parallel to one another and to ceiling plane 42.

A flange member 44 is connected to ring member 40 and is disposed to extend from exterior 43 and substantially parallel to plane 42.

A raised and relatively straight aligning shoulder 46 is connected to and disposed on a side of flange member 44 away from room 20 to butt against joist 34. After aligning shoulder 46 is aligned against joist 34, attaching ring 38 is fastened to joist 34 by driving a pair of nails 48 through passageways 50 in flange member 44.

Connected to interior 41 of ring member 40 are four triangular shaped mounting shoulders 52 that extend toward one another across interior 41 and are disposed substantially equidistant or at 90° offsets around interior 41 of ring member 40. Each triangular shaped mounting shoulder 52 has a screw receiving passageway 54 extending through shoulder 52 substantially parallel to ring member 40 and a butting surface 56 facing into room 20 when attaching ring 38 is secured to joist 34.

A triangular shaped wire connecting member 58 has two legs connected to interior 41 of ring member 40 to which a conductor running from a stereo or surround sound system may be attached for subsequent attachment to a speaker when made operational.

As best seen in FIGS. 2–5, a mounting ring 60 is included in mounting apparatus 36 by being connected to attaching ring 38.

Mounting ring 60 includes a substantially planar ring member 62 disposed to extend generally parallel to the plane 42 formed by ceiling 30. Ring 60 defines an opening 64 through which the sound passes into room 20. Opening 64 has a diameter that is smaller than the diameter formed by interior 41 of ring member 40 of attaching ring 38 so as to form a shoulder 66 extending interiorly of interior 41 of ring member 40 and facing away from room 20.

Four screws 68 are used in attaching planar ring member 62 of mounting ring 60 to attaching ring 38, each screw 68 being screwed into a passageway 54 of each one of connecting members 52. Planar ring member 62 has four passageways 70 with each passageway 70 aligned with a respective passageway 54 to provide access for screw 68 into its respective passageway 54. Also, each passageway 70 is countersunk into the front surface 72 of ring member 62 facing room 20 so that the head of screws 68 not extend past the outer surface of ring member 62 into room 20.

As best seen in FIGS. 2, 3 and 6–7, a speaker positioning device 74 is included in mounting apparatus 36 by being movably connected to mounting ring 60. Speaker positioning device 74 supports a speaker 76, one of speakers 12, 14, 16 or 18, at an angle Φ relative to front surface 72 of mounting ring member 62 and rotatably supports speaker 76 on mounting ring member 62 so that a sound directional axis 78 of speaker 76 may be rotated toward chosen position 32 in room 30. Angle Φ forms an acute angle relative to ceiling plane 42 and, preferably, the acute angle is about 10°.

Speaker 76 is supported in speaker positioning device 74 at angle Φ by a supporting portion 80, which includes a tubular body 82 defined by sidewalls 84 so that the sound will pass from speaker 76 into room 20. A first open end 86 that extends perpendicular to sidewalls 84 and a second open 88 end that extends at angle Φ relative to sidewalls 84. Extending along sidewalls 84 and around the periphery of first open end 86 are four upturned members 90. Upturned members 90 are equally displaced from one another or set at ninety degree centers around sidewalls 84. Each member 90 is constructed to receive a screw 92 in a passageway 94 so that speaker 76 is secured to first open end 86 of supporting portion 80.

Speaker 76 is supported in speaker positioning device 74 by an alignment portion 96 so that sound directional axis 76 in generally in alignment with chosen position 32 in room 20. Alignment portion 96 has a rim 98 extending around the periphery of second open end 88 of side walls 82 and when sitting on shoulder 66 of mounting ring 60 extends generally parallel to ceiling plane 42.

An indexing assembly 100 is used to index the direction of sound directional axis 76 for rotation through 360° and includes three outwardly extending members 102 extending away from rim 98 of alignment portion 96 and into complementary engagement with indexing passageways 104 disposed in shoulder 66 of ring member 62. The outwardly extending members 102 are provided at 120° offsets around rim 98 and indexing passageways 104 are provided at 15° offsets in shoulder 66.

If desired, an arrow 106 may be provided on speaker positioning device 74 to aid in determining the different positions of each speaker 12, 14, 16 and 18 in room 20 as each speaker 76 is being adjusted.

A grill 108 is disposed to extend across first open end 86 of speaker positioning device 74 to permit a person indexing speaker 76 to urge speaker positioning device 74 out of engagement with mounting ring 60 to adjust the direction of sound directional axis 78 toward position 32 without damaging speaker 76.

As best seen in FIGS. 2–5, movement limiting apparatus 110 is provided on mounting ring 60 to cooperate with rim 98 and limit movement of speaker positioning device 74 away from mounting ring 60. Movement limiting apparatus 110 includes a first, second and third movement limiting members 112, 114 and 116, respectively, disposed on and extending from back surface 118 of planar ring member 62 at 120° offsets around the ring.

First, second and third movement limiting members 112, 114 and 116, respectively, have an arcuate extension 120 that runs substantially parallel to opening 64 and from back 108 of planar ring member 62 away from room 20. Pivotally mounted, such as by screw 122, on the outer surface and substantially midway between the arcuate ends of arcuate extension 120 of first limiting member 112 is a tab 124. While fixed on the outer surface and substantially midway between the arcuate ends of arcuate extension 120 of each of second and third movement limiting members 114 and 116, respectively, is a tab 126 that extends from the outer surface of these limiting members toward opening 64.

Tabs 124 and 126 must be sufficiently disposed away from back 118 of ring member 62 so that rim 98 can be moved away from back 118 and upturned member 102 can become disengaged from ring member 62 to permit movement after attaching ring 38 is attached to joist 34 and mounting ring 60 is attached to attaching ring 38. This distance must, therefore, be at least the width of rim 98 and the length of the longest one of upturned members 102. Also, this distance should be sufficiently near so that speaker positioning device 74 will not rattle and make undesirable noises when speaker 76 is operating.

Figure 4:
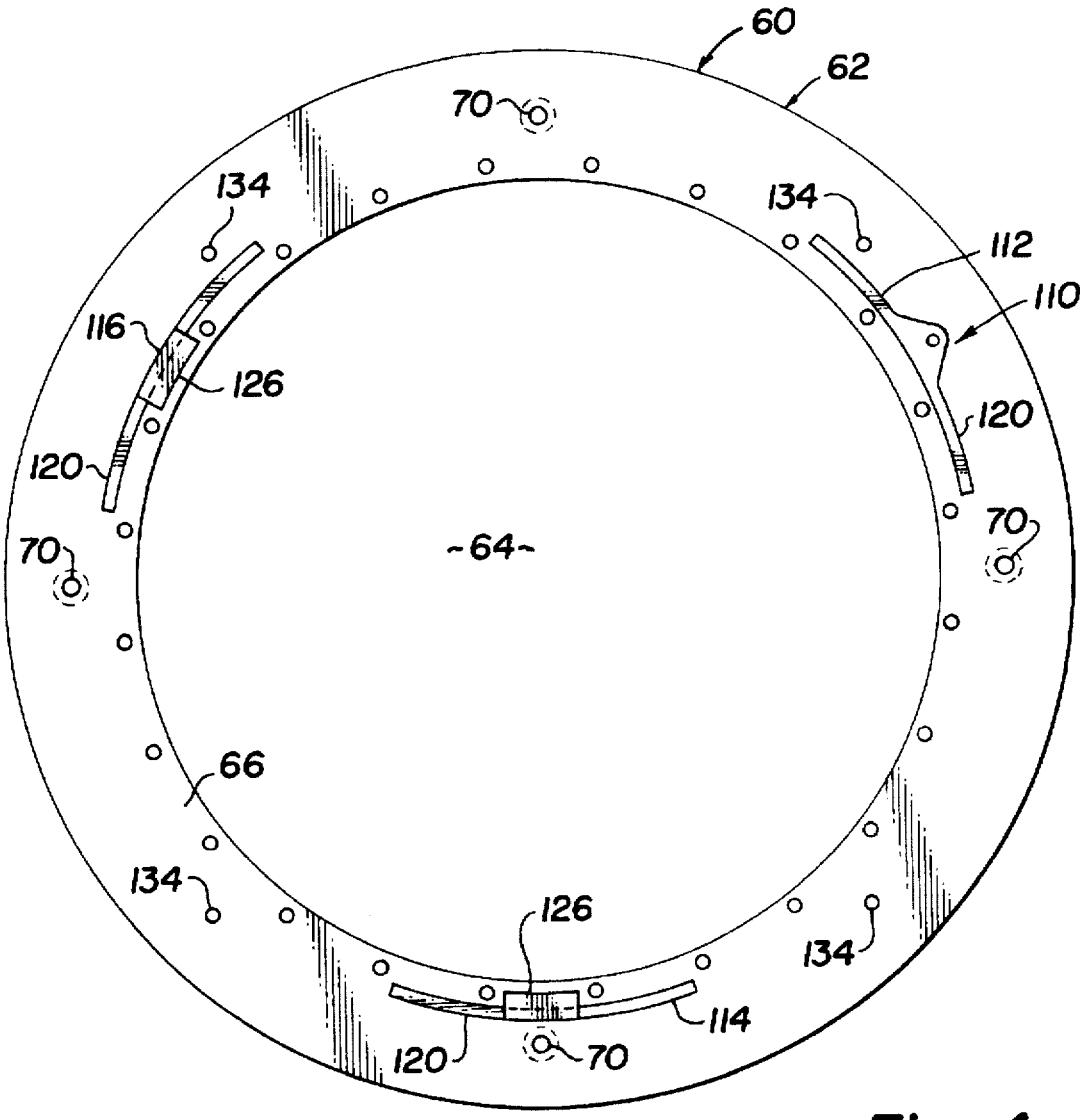
FIG. 4 is an enlarged, plan view of a mounting ring of the speaker mounting assembly shown in FIG. 2 when looking toward the floor of the room.
Figure 5:
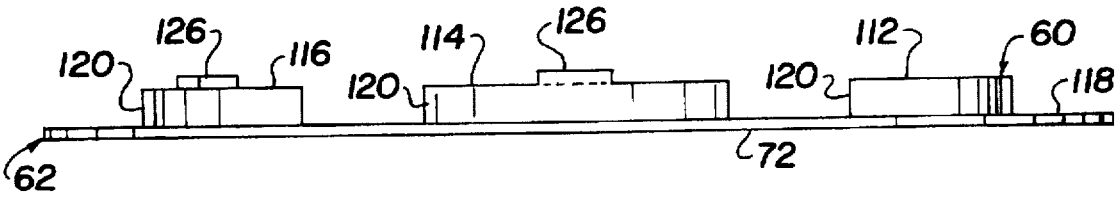
FIG. 5 is an elevational view of the mounting ring shown in FIG. 4.
Figure 6:
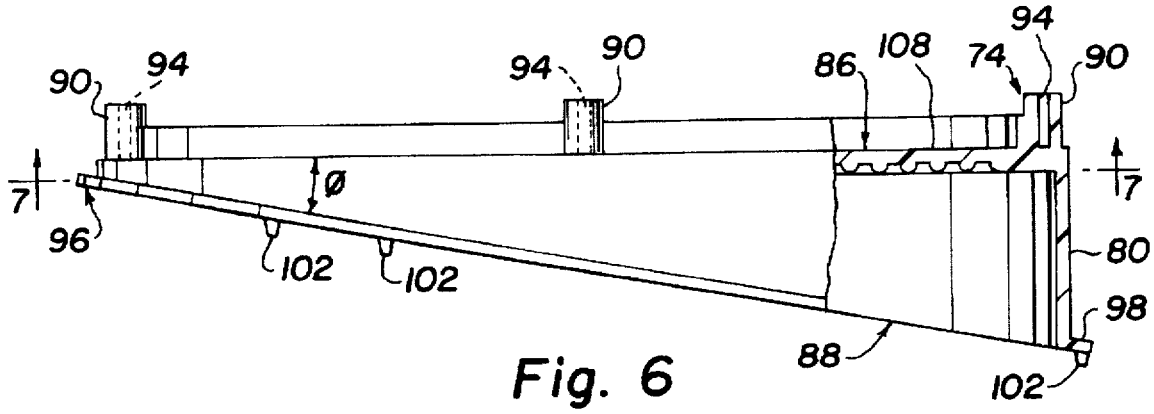
FIG. 6 an enlarged, elevational view of a positioning device of the speaker mounting assembly shown in FIG. 2.
Figure 7:
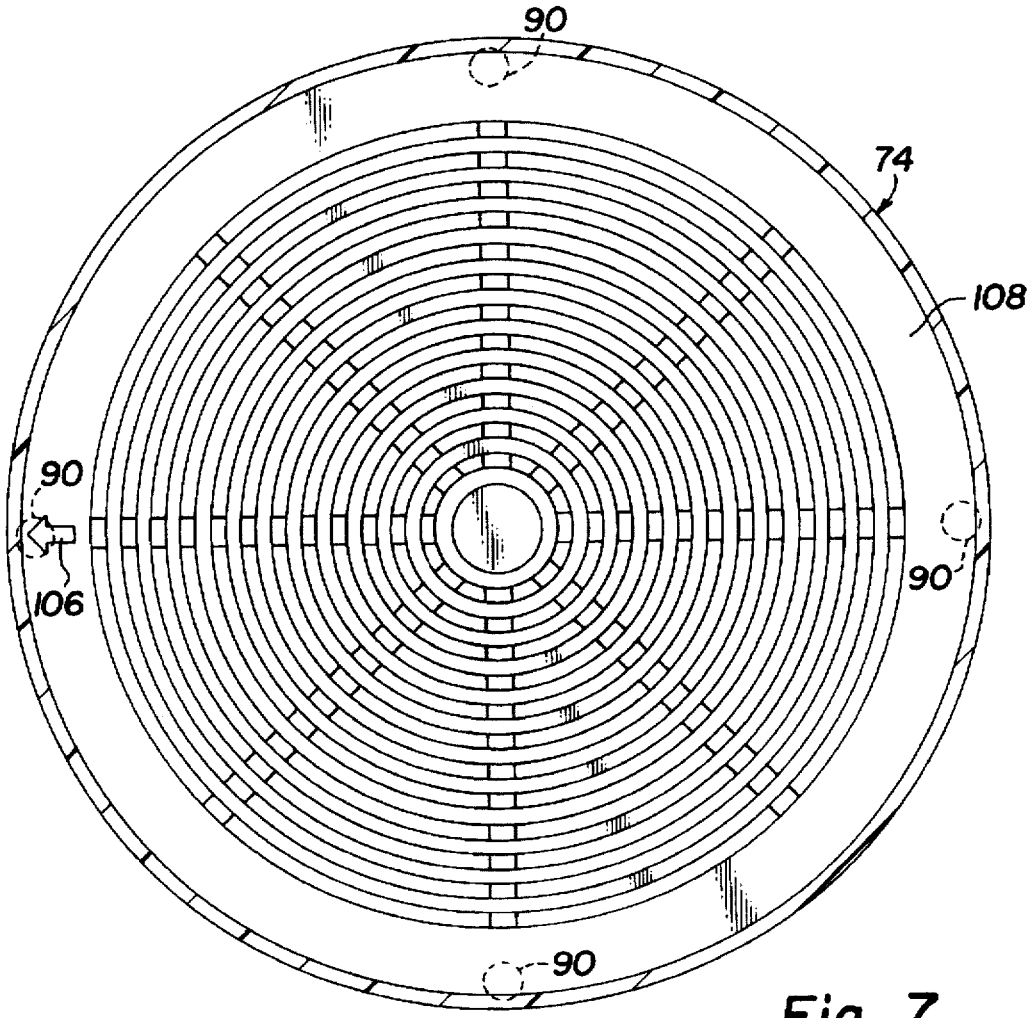
FIG. 7 is a cross-sectional, plan view of the positioning device shown in FIG. 6, as taken along lines 7—7 in the direction of the arrows.

As best seen in FIGS. 2 and 3, a ring 128 is used to cover front surface 72 of ring member 62 and provide an index mark for arrow 106 on speaker positioning device 74. Ring 128 has substantially the same outer diameter as ring member 62 with an opening 130 with substantially the same diameter as opening 64 and is connected to member 62 by four connecting members 132 disposed on 90° offsets around the ring and in alignment with four connecting passageways 134 provided in ring member 62, as seen in FIG. 4. Four indexing marks or slots 136 are positioned at 90° intervals around opening 130 and visible from room 20 so that a user can determine the relative position of each speaker 12, 14, 16 and 18 in relation to arrow 106 when moving the speakers toward chosen position 32.

To mount speaker 76 to a ceiling, attaching ring 38 is positioned with aligning shoulder 46 aligned with joist 34 and fastened in position with nail 48. Conducting wire is then run from the stereo or surround system and fastened to member 58. Speaker 76 with a sound direction axis 78 is fastened by screws to upturned member 90 so that the sound will be emitted into room 20. Rotatable tab 124 of first movement limiting member 112 is rotated out of the way. Rim 98 is slide beneath fixed tabs 126 on second and third movement limiting members 114 and 116 and ring member 62. Rotatable tab 124 is then rotated over rim 98. Speaker 76 and mounting ring 60 are moved to a position sufficiently near attaching ring 38 for the conductor wire to be fastened to speaker 76 in a conventional manner. Passageways 70 of mounting ring member 62 are aligned with screw receiving passageways in connecting member 52 of attaching ring 38 and screws 68 secure speaker 76, speaker positioning device 74 and mounting ring 60 to attaching ring 38. After four speakers 12, 14, 16 and 18 have been mounted to a ceiling joist 34 in this manner, speakers 12, 14, 16 and 18 are generally rotated into alignment with chosen position 32. Subsequent to this time, speakers 12, 14, 16 and 18 may be readjusted to a different chosen location without the necessity of tools by pushing against grill 108 and urging upturned members 102 away from engagement with mounting ring 60 and rotating the respective speaker 12, 14, 16 and 18 toward the new chosen location. By noting the changes in arrow 108 relative to indexing marks 136 on the mounting ring for the first speaker, the remaining speakers are adjusted to the appropriate position in attaching ring 38.

The invention having been described, what is claimed is:

1. A speaker arrangement for providing sound to a chosen position located in a room, comprising: at least two speakers capable of providing sound to the room, each speaker having a sound dispersion axis; and separate mounting means connected to each speaker for permanently connecting each speaker to a ceiling of the room at opposite sides of the chosen position, each said mounting means including an attaching ring adapted to be attached to a joist in the ceiling of the room, a mounting ring connected to the attaching ring, and adjustable positioning means connected to the mounting ring for supporting the speaker with its dispersion axis at an angle relative to a plane formed by the ceiling and for supporting the speaker in position after the dispersion axis is rotated toward the chosen position.

2. The speaker arrangement as set forth in claim 1, further comprising: the adjustable positioning means including an angle support portion adapted to support the speaker with its dispersion axis at an angle relative to a substantially planar ring member of the mounting ring.

3. The speaker arrangement as set forth in claim 1, further comprising: the adjustable positioning means including a rotating support portion adapted to support the speaker during rotating movement around a pivotal axis extending substantially perpendicular to a substantially planar ring member of the mounting ring.

4. The speaker arrangement as set forth in claim 3, further comprising: said adjustable positioning means including an angle support portion adapted to support the speaker with its dispersion angle at an acute angle relative to a plane formed by a substantially planar ring member of the mounting ring.

5. The speaker arrangement as set forth in claim 3, further comprising: the rotating support portion having a rotation preventing member adapted for complementary fitting in a passageway provided in the mounting ring and disposed to extend toward the mounting ring.

6. The speaker arrangement as set forth in claim 3, further comprising: a cover member adapted for complementary fitting over and connected to said mounting ring.

7. The speaker arrangement as set forth in claim 1, further comprising: the mounting ring including a movement limiting member for preventing movement of the positioning means away from the mounting ring past a selected distance.

8. The speaker arrangement as set forth in claim 7, further comprising: the positioning means including a rim, and the mounting ring including a substantially planar ring member and the movement limiting member having a member extending from the planar ring member by a predetermined amount and a lip extending over the rim of the positioning means to prevent movement of the positioning means away from said mounting ring.

9. Apparatus for mounting a speaker to a joist of a room, comprising: an attaching ring adapted to be permanently attached to the joist; a mounting ring connected to said attaching ring; and adjustable positioning means for supporting an axis of sound dispersion of the speaker at an angle relative to a plane formed by a front surface of said mounting ring and for rotatably supporting the speaker on said mounting ring so that the dispersion axis of the speaker may be rotated toward a chosen position in the room.

10. Apparatus as set forth in claim 9, further comprising: said positioning means including an angle support portion supporting the axis of the speaker at an angle relative to a substantially planar ring member of said mounting ring.

11. Apparatus as set forth in claim 10, further comprising: the angle support portion supporting the axis of the speaker at a fixed angle relative to a substantially planar ring member of said mounting ring.

12. Apparatus as set forth in claim 11, further comprising: the angle support portion supporting the axis of the speaker at an acute angle relative to a substantially planar ring member of said mounting ring.

13. Apparatus as set forth in claim 9, further comprising: said positioning means including a rotating support portion adapted to support the speaker during rotating movement around a pivotal axis extending substantially perpendicular to a substantially planar ring member of said mounting ring.

14. Apparatus as set forth in claim 13, further comprising: said positioning means including an angle support portion adapted to support the dispersion axis of the speaker at an acute angle relative to a plane formed by a substantially planar ring member of said mounting ring.

15. Apparatus as set forth in claim 14, further comprising: the angle support portion supporting the dispersion axis of the speaker at a fixed angle relative to a substantially planar ring member of said mounting ring.

16. Apparatus as set forth in claim 15, further comprising: the angle support portion supporting the dispersion axis of the speaker at an acute angle relative to a substantially planar ring member of said mounting ring.

17. Apparatus as set forth in claim 13, further comprising: the rotating support portion having a rotation preventing member adapted for complementary fitting in a passageway provided in said mounting ring and disposed to extend toward said mounting ring.

18. Apparatus as set forth in claim 9, further comprising: a cover member adapted for complementary fitting over and connected to said mounting ring.

19. Apparatus as set forth in claim 9, further comprising: said mounting ring including a movement limiting member for preventing movement of said positioning means away from said mounting ring past a selected distance.

20. Apparatus as set forth in claim 19, further comprising: said positioning means including a rim; and said mounting ring including a substantially planar ring member and the movement limiting member having a member extending from the planar ring member by a predetermined amount and a lip extending over the rim of said positioning means to prevent movement of said positioning means away from said mounting ring.

21. The speaker arrangement as set forth in claim 1, further comprising: a second set of two speakers cooperating with the first set of two speakers to provide surround sound to the room; and a second set of separate mounting means connected to each speaker for permanently connecting each speaker of said second set of two speakers to the ceiling at opposite sides of the chosen position, each said mounting means of said second set including an attaching ring adapted to be attached to a joist in the ceiling of the room, a mounting ring connected to the first attaching ring, and adjustable positioning means connected to the first mounting ring for supporting the speaker with its dispersion axis at an acute angle relative to a plane formed by the ceiling and for supporting the speaker in position after the dispersion axis is rotated toward the chosen position.

* * * * *